United States Patent [19]

Trigg

[11] Patent Number: 4,966,687

[45] Date of Patent: Oct. 30, 1990

[54] METHOD AND APPARATUS FOR COLUMN FLOTATION OF MINERAL MATTER

[75] Inventor: Richard D. Trigg, Glenolden, Pa.

[73] Assignee: The Standard Oil Company, Cleveland, Ohio

[21] Appl. No.: 810,864

[22] Filed: Dec. 19, 1985

[51] Int. Cl.[5] ..... B03D 1/14; B03D 1/00; B03D 1/02

[52] U.S. Cl. ..... 209/164; 209/168; 209/169

[58] Field of Search ..... 209/164, 166, 167, 168, 209/169, 170; 210/703, 704

[56] References Cited

U.S. PATENT DOCUMENTS

| | | | |
|---|---|---|---|
| 1,223,033 | 4/1917 | Cole . | |
| 1,367,332 | 1/1921 | Towne et al. . | |
| 4,028,229 | 6/1977 | Dell | 209/164 |
| 4,592,834 | 6/1986 | Yang | 209/166 |

OTHER PUBLICATIONS

Sastry, et al., Theoretical Analysis of a Countercurrent Flotation Column, Transactions SME/AIME, vol. 247, No. 1, pp. 46–52 (Mar., 1970).

*Primary Examiner*—Kenneth M. Schor
*Attorney, Agent, or Firm*—Michael F. Esposito; David J. Untener; Larry W. Evans

[57] ABSTRACT

Apparatus for the separation of components of a slurry by froth flotation is disclosed. The apparatus includes a flotation column having an upper section, an intermediate section and a lower section, a spray bar, mounted in the intermediate section of the flotation column, for providing a downwardly directed fine mist in the intermediate section of said flotation column, and at least one spray nozzle mounted in the lower section of the flotation column, the at least one spray nozzle provided with aerating means. A method for the separation of the components of a slurry employing the present apparatus is also disclosed.

8 Claims, 2 Drawing Sheets

METHOD AND APPARATUS FOR COLUMN FLOTATION OF MINERAL MATTER

BACKGROUND OF THE INVENTION

The present invention relates to a method and apparatus for the froth flotation separation of minerals and other particulate matter and more particularly relates to a method and apparatus for the concentration and beneficiation of carbonaceous matter, especially coal, by column flotation.

Valuable minerals are commonly found in nature mixed with relatively large quantities of unwanted gangue materials, and as a consequence it is usually necessary to beneficiate the ores in order to concentrate the mineral content thereof. Mixtures of finely divided mineral particles and finely divided gangue particles can be separated and a mineral concentrate obtained therefrom by well known froth flotation techniques. Broadly speaking, froth flotation involves conditioning an aqueous slurry or pulp of the mixture of mineral and gangue particles with one or more flotation reagents which will promote flotation of either the mineral or the gangue constituents of the pulp when the pulp is aerated. The conditioned pulp is aerated by introducing into the pulp a plurality of minute air bubbles which tend to become attached either to the mineral particles or the gangue particles of the pulp, thereby causing these particles to rise to the surface of the body of pulp and form a float fraction which overflows or is withdrawn from the flotation apparatus.

Coal is an extremely valuable natural resource in the United States because of its relatively abundant supplies. It has been estimated that the United States has more energy available in the form of coal than in the combined natural resources of petroleum, natural gas, oil shale, and tar sands. Recent energy shortages, together with the availability of abundant coal reserves and the continuing uncertainties regarding the availability of crude oil, has made it imperative that improved methods be developed for converting coal into a more useful energy source.

Regardless of the form in which the coal is ultimately employed, the coal or coal combustion products must be cleaned because they contain substantial amounts of sulfur, nitrogen compounds and mineral matter, including significant quantities of metal impurities. During combustion these materials enter the environment as sulfur dioxides, nitrogen oxides and compounds of metal impurities. If coal is to be accepted as a primary energy source, it must be cleaned to prevent pollution of the environment either by cleaning the combustion products of the coal or by cleaning the coal itself prior to burning.

Accordingly, physical as well as chemical coal cleaning (beneficiation) processes have been explored. In general, physical coal cleaning processes involve pulverizing the coal to release the impurities, wherein the fineness of the coal generally governs the degree to which the impurities are released. However, because the costs of preparing the coal rise exponentially with the amount of fines to be treated, there is an economic optimum in size reduction. Moreover, grinding coal even to extremely fine sizes may not be effective in removing all the impurities. Based on the physical properties that effect the separation of the coal from the impurities, physical coal cleaning methods are generally divided into four categories: gravity, flotation, magnetic and electrical methods. In contrast to physical coal cleaning, chemical coal cleaning techniques are in a very early stage of development. Known chemical coal cleaning techniques include, for example, oxidative desulfurization of coal (sulfur is converted to a water-soluble form by air oxidation), ferric salt leaching (oxidation of pyritic sulfur with ferric sulfate), and hydrogen peroxide-sulfuric acid leaching.

Particularly desirable coal beneficiation processes are disclosed in relatively recently issued U.S. Pat. Nos. 4,412,843, 4,347,126, 4,347,127 and 4,514,291.

U.S. Pat. No. 4,412,843 discloses a froth flotation process whereby coal particles are made highly hydrophobic and oleophilic by utilizing surface treating chemicals. U.S. Pat. Nos. 4,347,126 and 4,347,127 disclose improved coal beneficiation processes, which may be used in conjunction with the process disclosed in U.S. Pat. No. 4,412,843 and which advantageously utilize spray nozzles in the flotation process. In turn, U.S. Pat. No. 4,514,291 discloses a coal beneficiation process which utilizes a spiral type spray nozzle to provide further advantages over those provided by the previously disclosed processes.

Various types of flotation systems are available including conventional flotation which relies on a draining froth bed to separate the mineral-laden bubbles from the slurry and column flotation which operates as a counter-current system with the bubbles rising through a downward stream of wash-water.

Literature references comparing the various aspects of conventional flotation with column flotation are available. Some of these include Mathieu, "Comparison Of Flotation Columns With Conventional Flotation For Concentration Of a Molybdenum Ore," Extractive Metallurgy, pp. 1–5, (1972), Sastry et al., "Theoretical Analysis Of A Countercurrent Flotation Column." Transactions SME/AIME, Vol. 247, No. 1, pp, 46–52 (March, 1970) and Dell, "Column Flotation Of Coal—The Way To Easier Filtration" (1976). Patents which disclose various column flotation methods and apparatus include U.S. Pat. Nos. 4,436,617, 3,371,779, 3,339,730, 3,298,519, 2,897,144, 2,047,989, 1,367,332, 1,314,316, 1,223,033, German Pat. No. 213,141 and Swedish Pat. No. 121,991.

While it is obvious from the foregoing that enormous efforts have been made to beneficiate ores, particularly coal, further work and improvements are still necessary and desirable particularly before coal and other solid carbonaceous fuel sources will be accepted on a wide scale as primary sources of energy.

SUMMARY OF THE INVENTION

Accordingly, it is one object of the present invention to provide a method and apparatus for froth flotation separation of the components of an ore.

Another object of this invention is to provide a method and apparatus for the beneficiation of solid carbonaceous matter, particularly coal.

Still another object of the present invention is to provide an improved method and apparatus for froth flotation separation of the components of an ore employing column flotation.

A still further object of the present invention is to provide an improved method and apparatus for the beneficiation of coal employing column flotation.

These and other objects are accomplished herein by an apparatus for the separation of components of a slurry of ore by froth flotation, said apparatus comprising:

(i) a flotation column having an upper section, an intermediate section and a lower section;

(ii) means for introducing and providing a downwardly flowing stream of aqueous medium in said intermediate section of said flotation column;

(iii) at least one spray nozzle mounted in said lower section of said flotation column; and (iv) means for introducing air to said at least one spray nozzle.

The objects of the present invention are also accomplished herein by a method for the separation of the components of a comminuted mixture of ore by froth flotation, said method comprising the steps of:

(i) establishing and maintaining a downwardly flowing stream of aqueous medium within a vertically aligned, elongated zone, said aqueous medium being introduced at an intermediate section of said vertically aligned, elongated zone; and (ii) introducing into a lower section of said vertically aligned, elongated zone an aerated particulate aqueous slurry of a comminuted mixture of ore thereby creating a froth containing particulate mineral matter and establishing and maintaining an upwardly moving stream of said froth.

DETAILED DESCRIPTION OF THE INVENTION

Figure 1:
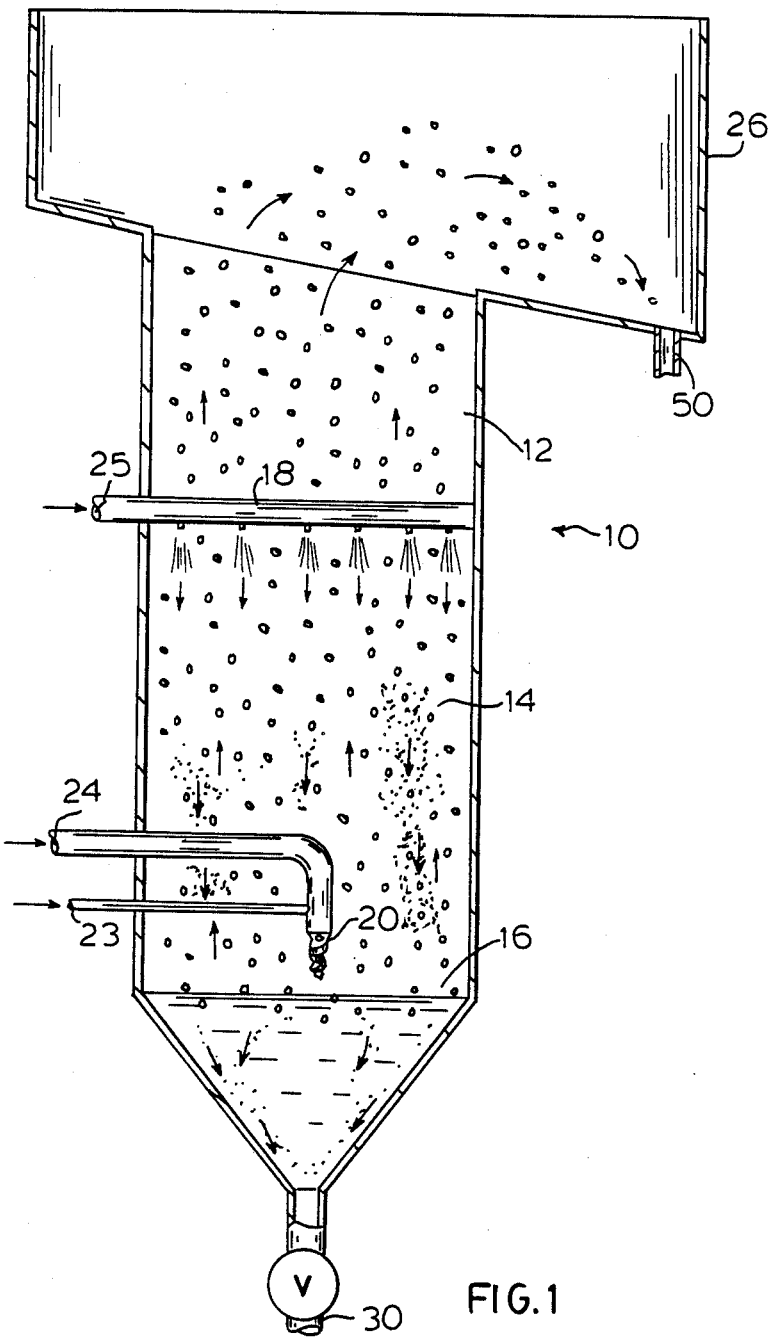
FIG. 1 is a schematic view of one embodiment of the method and apparatus of the present invention.
Figure 2:
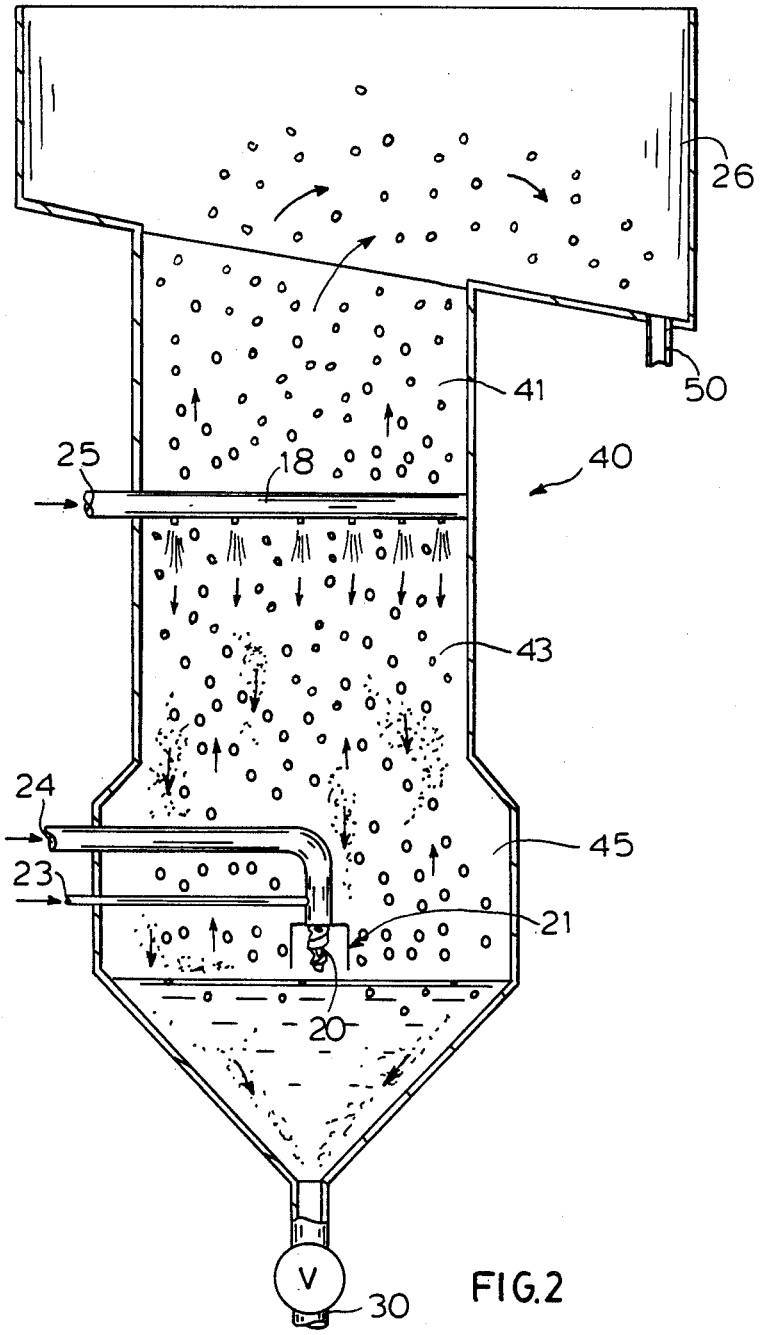
FIG. 2 is also a schematic view of another embodiment of the method and apparatus of the present invention.

Referring to FIG. 1, the flotation column 10 comprises an upper section 12, an intermediate section 14 and a lower section 16. The cross-section of the flotation column 10 may be circular, elliptical, square, rectangular, or any other transverse section of a plan geometrical figure. Preferably the cross-section is circular, and, as illustrated in FIGS. 1 and 2, the upper section and intermediate cross-sections may be circular and the lower section may be conical. The length of the column should be greater than the width and a ratio of length:-width of about 3:1 to about 100:1 is generally satisfactory. It is preferred that the inside surfaces of the column be made of hydrophilic material to assist in inducing drainage of the froth along the column walls.

Means for providing a downwardly flowing stream of aqueous medium, such as a spray bar 18, is mounted in the intermediate section 14. Spray bar 18 is preferably adapted to provide a plurality of fine, mist sprays of water, for example, to the flotation column. A spray nozzle 20, preferably of the spiral hollow cone or full cone type, is mounted in the lower section 16 of the column. Spray nozzle 20 is provided with an air inlet means 23.

The dimensions of each of sections 12, 14 and 16 of the flotation column are not critical. The upper section 12 is defined as that portion of the column 10 which is above spray bar 18 and this section should be of a sufficient length and width to allow sufficient froth drainage time for the removal o undesired hydrophilic material in the froth and obtain an optimum percentage of solids in the froth prior to removal. The amount of drainage time to be considered sufficient will vary with the type of particulate matter being separated, the percentage of gangue, and the ability of the rising froth to continue rising to the removal zone. Intermediate section 14 is defined as that portion of the column 10 which is immediately below upper section 12, i.e. at about spray bar 18, and above the inlet 24 to spray nozzle 20 mounted in said lower section 16 and should be of a sufficient length and width to allow a stable froth to form prior to encountering the direct spray of the wash water. In turn, lower section 16 is that portion of column 10 which is below the inlet 24 to spray nozzle 20. In general, lower section 14 should be of sufficient volume to permit a froth to form and also to allow adequate tailings removal.

In operation and for example, a coal-aqueous slurry which has been conditioned with surface treating reagents as, for example, disclosed in U.S. Pat. No. 4,412,843, incorporated by reference herein, is introduced at inlet 24 and is aerated by air introduced at inlet 23 prior to reaching spray nozzle 20. The resultant aerated slurry forms a froth after exiting the spray nozzle 20. As the froth forms, water containing mostly hydrophilic gangue flows to the bottom of the column. The froth containing the desired solid carbonaceous component flows up the column. Water is introduced at inlet 25 to spray bar 18 and is sprayed into the column to provide a counter-current flow down the column and thus induce drainage of the hydrophilic material from the froth. Various reagent solutions, such as ethanol and other alcohol solutions and other solutions which reduce the surface tension of water such as frothers, dispersants like caustic soda, pine oil and the like may be used in conjunction with water in the counter-current flow to further help induce the removal of hydrophilic particles from the froth. Foam, comprising solid carbonaceous particles such as coal, which reaches the top of the column, is introduced to catch pan 26. Tailings and hydrophilic gangue are discharged at outlet 30.

The operation of the apparatus and of the method of the present will be described herein in more detail with reference to FIG. 1 for the beneficiation of coal to be froth floated. Of course, it is equally applicable for ores and other solid carbonaceous matter which may be desired to be beneficiated or concentrated.

An aqueous slurry of finely ground coal particles, associated impurities and if desired surface-treating additives such as monomer, chemical initiators, catalysts and fluid hydrocarbon carriers is introduced to the lower section 16 of column 10 at inlet 24 and through spray nozzle 20 and into water contained in lower section 16 (at a level below the nozzle exit) as illustrated. The slurry is supplied to the spray nozzle 20 under pressure generally within the range of from about 5 to about 40 psi and more preferably in the range of from about 15 to 20 psi. Water is supplied to the intermediate section 14 of column 10 at inlet 25 and sprayed from spray bar 18 into the column. Air is introduced to spray nozzle 20 at inlet 22. Aerated slurry exiting spray nozzle 20 forms a froth and as the froth forms, water containing large amounts of hydrophilic gangue falls to the bottom of the column. Froth containing particulate coal moves up the column. The water being sprayed from spray bar 18 induces drainage of the gangue. Once the froth reaches the top of the column it is introduced to the catch pan 26.

FIG. 2 illustrates another embodiment of the flotation column of the present invention wherein the lower section 45 of the flotation column 40 is wider in dimension than the upper section 41 and the intermediate section 43. Similar to the embodiment in FIG. 1, means for providing a downwardly flowing stream of aqueous medium, such as spray bar 18 is provided in intermediate section 43. Spray nozzle 20 is mounted in the lower section 45 of the column 40. In this embodiment too, the dimensions for each of sections 41, 43 and 45 are not critical but are defined similarly to sections 12, 14 and 16 respectively in FIG. 1. Coal-aqueous slurry is introduced at inlet 24 and is aerated by air introduced at inlet 23 prior to reaching spray nozzle 20. The resultant aerated slurry forms a froth after exiting spray nozzle 20. As the froth forms, water containing mostly hydrophilic gangue flows to the bottom of the column. As in FIG. 1, the froth containing the desired carbonaceous component moves up the column. Water is introduced at inlet 25 to spray bar 18 and is sprayed into the column to provide a counter-current flow down the column and thus induce drainage of the hydrophilic material from the froth. The foam which reaches the top of the column enters catch pan 26 and is removed through outlet 50. The froth may be removed from catch pan 26 by any scraping means or drainage means. Tailings and hydrophilic gangue are discharged at outlet 30 by opening the valve means. FIG. 2 also illustrates the use of a protective partition 21 to protect the rising froth from spray nozzle 20.

In carrying out the foregoing method of the present invention wherein raw mined coal is employed as the feedstock, it is initially preferred to reduce raw mined coal or other solid carbonaceous material to a fine diameter size and to remove unwanted rock, heavy ash and the like materials collected in the mining operation. Thus, the coal is pulverized and initially cleaned, usually in the presence of water, wherein the coal is suspended and/or sufficiently wetted to permit fluid flow. The coal is crushed (pulverized) employing conventional equipment such as, for example, ball or rod mills, breakers and the like.

It is generally desirable, although not necessary to employ certain water conditioning (treating) additives in the pulverization operation. Such additives assist in rendering the ash more hydrophilic which facilitates the separation thereof. Typical additives which are useful for purposes of this invention include conventional inorganic and organic dispersants, surfactants, and/or wetting agents. Preferred additives for this purpose include sodium carbonate, sodium pyrophosphate, and the like.

The coal-aqueous slurry formed in the pulverization operation is typically one having a coal to water ratio of from about 0.5:1 to about 1:5 and preferably about 1:3 parts by weight, respectively. If utilized, the water treating additives as hereinbefore described are employed in small amounts, usually, for example, from about 0.025 to about 5% by weight based on the weight of dry coal. While it is generally recognized that more impurities are liberated as the size of the coal is reduced, the law of diminishing returns applies in that there is economic optimum which governs the degree of pulverization. In any event, for the purposes of this invention, it is generally desirable to crush the coal to a particle size of from about 28 to about less than 325 mesh, preferably about 80% of the particles being of about a 200 mesh size (Tyler Standard Screen Size).

Any type coal can be employed in the beneficiation process herein. Typically, these include, for example, bituminous, sub-bituminous, anthracite, lignite and the like. Other solid carbonaceous fuel materials, such as the oil shale, tar sands, coke, graphite, mine tailings, coal from refuse piles, coal processing fines, coal fines from mine ponds or tailings, carbonaceous fecal matter and the like are also contemplated for treatment by the process herein. Thus, for the purposes of this invention, the term "coal" is also intended to include these kinds of other solid carbonaceous fuel materials or streams.

Thus, in accordance with the present invention, a column froth flotation process is provided which utilizes spray nozzles, preferably spiral spray nozzles, to apply shearing forces to the carbonaceous pulp as it is pumped through the nozzles. The spraying action disperses solid carbonaceous particulate matter and ash particles in a pneumatic zone above the liquid level in the column. Air is introduced to the spray nozzle in order to help disperse the particles, control the amount of air exposed to the pulp and thus extend the amount of control on the flotation rate. The spray nozzles are located above the aqueous pulp surface in the column, allowing flotation to occur at the aqueous surface and not within the aqueous phase. This aids to reduce the amount of fine ash material being transported to the froth which often occurs with prior processes in which bubbles and bubble/particle aggregates travel through the ash-laden pulp in order to reach a surface froth. The utilization of a spray bar herein supplies a fine, misty spray of water or a reagent solution which enhances drainage in the froth. Thus, the present process not only reduces the amount of entrained ash in the froth but may reduce the moisture content of the froth depending upon the area of column above the spray bar and thus the drainable time allowed for the froth. This allows for the separation of ash material from the clean coal in the froth phase and not in the aqueous phase.

While the present invention has been described with particular reference to the beneficiation of coal, the present invention is operative in the froth flotation of any ore which has successfully been separated into value and gangue by froth flotation in the past. Non-limiting examples of suitable ores include:

(1) sulphides, for example cinnabar, cobaltite, smaltite, erythrite, chalcocite, covellite, chalcopyrite, bornite, galena, pyrite, marcasite, pyrrhotite, arsenopyrite, linneite, molybdenite, realgar, argentite and sphalterite;

(2) native metals, for example, gold, silver, copper and bismuth;

(3) oxides, for example, bauxite, cassiterite, chromite, cuprite, ilmenite, hematite, specularite, manganosite, molybdite, rutile, alunite, anglesite and cerrisite;

(4) non-silicate minerals of alkali and alkaline earth metals, for example, barite, calcite, celestite, cryolite, dolomite, fluorospar, magnesite, strontianate, halite and sylvite; and (5) silicates, for example, andalusite, brucite, olivine, kyanite, mica, quartz and spodumene, and (6) phosphates.

Obviously, other modifications and variations of the present invention are possible in the light of the above teachings. It is, therefore, to be understood that changes may be made in the particular embodiments of this invention which are within the full intended scope of the invention as defined by the appended claims.

I claim:

1. A method for the separation of the components of a slurry of ore by froth flotation in a vertically aligned, elongated zone having an upper section, an intermediate section and a lower section, said method comprising the steps of:

(i) introducing an aerated particulate aqueous slurry of ore into said lower section of said vertically aligned, elongated zone and above the level of a liquid medium contained in said lower section of said vertically aligned, elongated zone thereby creating a froth containing mineral matter and establishing and maintaining an upwardly moving stream of said froth; and (ii) establishing and maintaining a downwardly flowing stream of aqueous medium within said intermediate section of said vertically aligned, elongated zone and above said level of liquid medium in said lower section of said vertically aligned, elongated zone thereby enhancing drainage of said upwardly moving stream of said froth.

2. The method of claim 1 wherein said aerated particulate aqueous slurry of ore is introduced into said lower section of said elongated zone by spraying through at least one spray nozzle.

3. The method of claim 2 wherein said spray nozzle is a spiral spray nozzle.

4. The method of claim 1 wherein said particulate aqueous slurry of ore is a coal-aqueous slurry.

5. The method of claim 1 wherein said upwardly moving stream of froth is recovered from said upper section of said vertically aligned, elongated zone.

6. The method of claim 1 wherein said downwardly flowing stream of aqueous medium is provided by a plurality of fine mist sprays.

7. Apparatus for the separation of components of a slurry of ore by froth flotation, said apparatus comprising:

(i) a flotation column having an upper section, an intermediate section and a lower section, said lower section adapted to contain a liquid medium at a predetermined level;

(ii) means provided in said intermediate section of said flotation column above said predetermined level of said liquid medium for introducing and providing a downwardly flowing stream of aqueous medium in said intermediate section of said flotation column;

(iii) at least one spray nozzle provided in said lower section of said flotation column and above said predetermined level of said liquid medium; and (iv) means for introducing air to said at least one spray nozzle;

wherein said means for introducing and providing a downwardly flowing stream of aqueous medium is comprised of an elongated bar extending horizontally into said intermediate section of said flotation column and adapted to provide a downwardly directed fine mist spray.

8. Apparatus for the separation of components of a slurry of ore by froth flotation, said apparatus comprising:

(i) a flotation column having an upper section, an intermediate section and a lower section, said lower section adapted to contain a liquid medium at a predetermined level;

(ii) means provided in said intermediate section of said flotation column above said predetermined level of said liquid medium for introducing and providing a downwardly flowing stream of aqueous medium in said intermediate section of said flotation column;

(iii) at least one spray nozzle provided in said lower section of said flotation column and above said predetermined level of said liquid medium; and (iv) means for introducing air to said at least one spray nozzle;

wherein said at least one spray nozzle is a spiral nozzle.

* * * * *